United States Patent [19]

Charron et al.

[11] Patent Number: 4,491,092

[45] Date of Patent: Jan. 1, 1985

[54] SEALED FORCED-DRAFT GAS BOILER DISPOSITION

[75] Inventors: Jean-Claude Charron, Saint-Maur; Philippe Mulsant, Villiers sur Marne; Yvan Poujoulat, Champs sur Marne, all of France

[73] Assignee: Societe Anonyme Saunier Duval/Eau Chaude/Chauffage-S.D.E.C.C., Paris, France

[21] Appl. No.: 539,054

[22] Filed: Oct. 4, 1983

[30] Foreign Application Priority Data

Oct. 5, 1982 [FR] France ..... 82 16664

[51] Int. Cl.[3] ..... F22B 5/02

[52] U.S. Cl. ..... 122/18; 122/14; 122/17; 122/19; 122/23; 126/350 R

[58] Field of Search ..... 122/14, 19, 17, 18, 122/23, 24, 25; 126/350 R

[56] References Cited

U.S. PATENT DOCUMENTS 1,923,614 8/1933 Clarkson ..... 122/23 X 3,921,592 11/1975 Calvin et al. ..... 122/262

4,287,857 9/1981 Schnitzer ..... 122/23

4,413,590 11/1983 Landreau ..... 122/18

4,426,037 1/1984 Bernstein ..... 122/19 X

*Primary Examiner*—Edward G. Favors

*Attorney, Agent, or Firm*—Kerkam, Stowell, Kondracki & Clarke

[57] ABSTRACT

The invention relates to a forced draft household gas boiler having a sealed enclosure for the combustion assembly of the boiler.

A sealed shell (15) envelopes a cylindrical heat exchanger (6) and is suspended in the upper half of a frame (1) from a horizontal plate (4) so that a central inlet opening (11) of the heat exchanger is in the axis of an outlet tube (32) of a fan (29) which directs an air/gas mixture into the burner. An outlet opening (23) for the combustion products collected in the sealed shell (15) is located within the circumference of the shell and at least approximately in the axis of an evacuation pipe (18) for evacuating combustion products external of the boiler.

15 Claims, 1 Drawing Figure

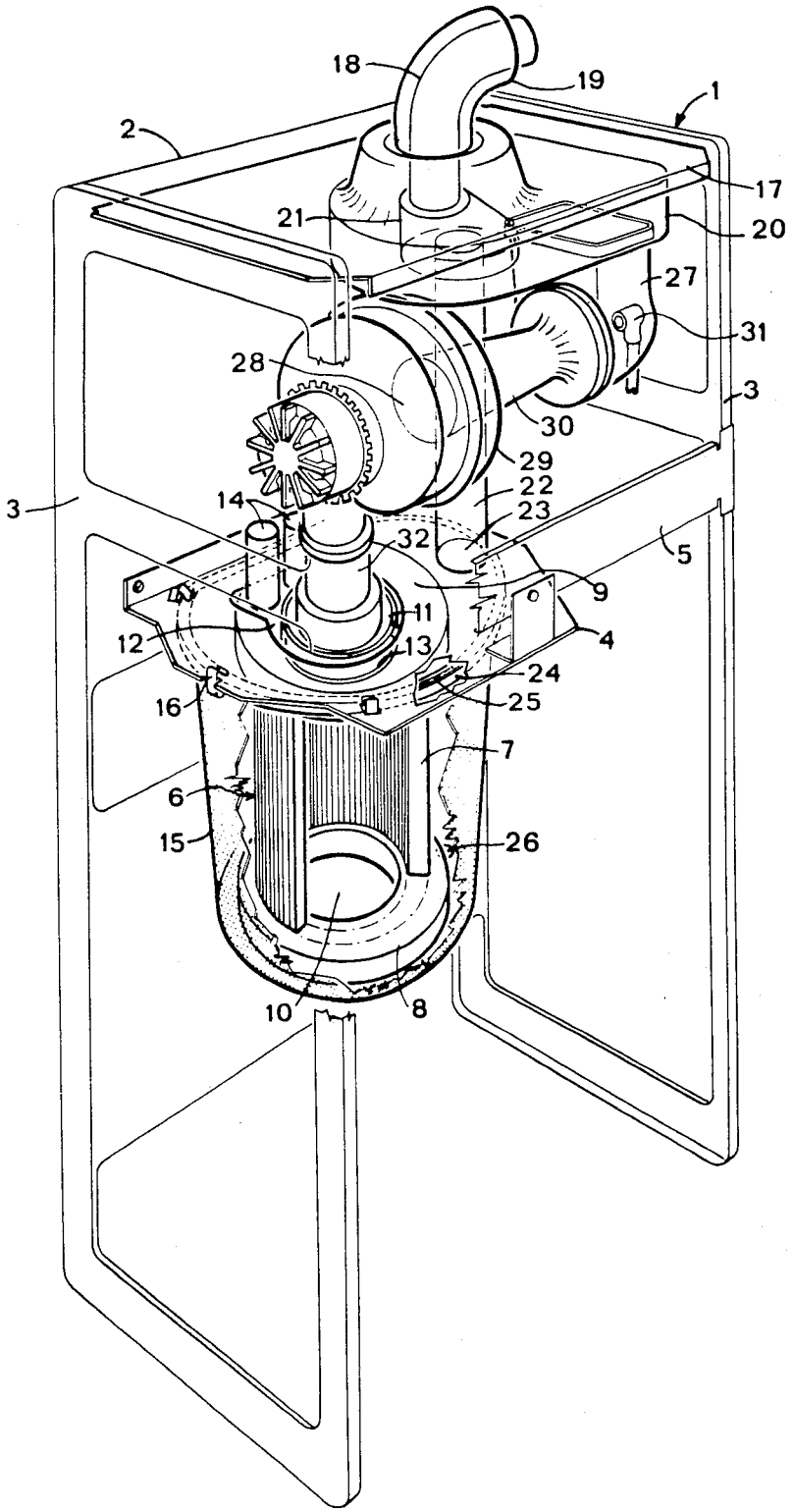
18
19
1
2
17
21
20
27
31
28
3
30
29
22
3
14
23
32
5
9
11
12
13
4
24
16
25
7
6
15
26
10
8

SEALED FORCED-DRAFT GAS BOILER DISPOSITION

BACKGROUND OF THE INVENTION

The invention relates to a sealed forced-draft gas boiler, and more particularly to a novel disposition of the sealed enclosure provided for evacuating combustion products from the gas boiler.

Gas boilers are known in which a combustion chamber, connected to the atmosphere outside the premises, is insulated in a gas-tight manner with regard to these premises. In some cases such boilers are surrounded by an intermediate chamber serving to deliver air and enveloping the combustion chamber in a sealed manner, the latter being incorporated in turn in the external casing of the apparatus. In other known apparatus, the external casing of the apparatus itself embodies this sealed intermediate chamber, and the combustion products are evacuated from this combustion chamber by way of a hood, a blow off fan and an outlet pipe. It is known to be advantageous for the outlet pipe to be disposed concentrically with the fresh-air intake pipe.

Boilers are also known in which the heat exchanger comprises a cylindrical bundle of tubes interconnected by end headers; the heat exchanger defines a combustion chamber through which the flame of a burner passes, giving up its heat to the water circulating in the heat exchanger tubes. Certain preferred embodiments provide that this heat exchanger be disposed upright in the interior of an insulating casing, the burner being disposed just above the combustion chamber.

However, these boiler types nevertheless have a certain number of disadvantages in terms of their assembly, their accessibility and especially their tightness, because tightness must be assured at the points where gas or water tubes intersect, which creates a certain number of problems.

OBJECT AND SUMMARY OF THE INVENTION

It is accordingly the object of the present invention to overcome the above-discussed inherent disadvantages of such apparatus. To this end, the invention relates to a sealed forced draft household gas boiler characterized by the fact that a sealed, anti-noise shell enveloping a cylindrical heat exchanger is suspended in the upper half of the boiler frame from a horizontal plate, above which plate the air inlet pipe, the evacuation pipe for the products of combustion and the fan are disposed. Furthermore, according to the invention the central inlet opening of the heat exchanger at the level of the plate is located in the axis of the outlet tube of the fan and the outlet opening for the products of combustion collected by the sealed shell traverses that plate and is located at least approximately within the axis of the pipe for evacuating these products to outside the boiler.

The invention will be better understood from the ensuing description of one exemplary embodiment, taken in conjunction with the drawing.

BRIEF DESCRIPTION OF THE DRAWING

The single figure of the drawing shows a perspective view of the apparatus in its entirety.

DESCRIPTION OF THE PREFERRED EMBODIMENT

The boiler shown in the drawing includes a frame 1 having a back 2 for the purpose of affixing it on the mounting wall of the premises and lateral reinforcements 3 which have large access openings; these elements 2 and 3 together comprise the frame 1 of the apparatus. A horizontal plate 4 is secured to the back 2 in the upper half of the frame 1 and is also supported by an angle bar 5 disposed transversely with respect to the front lateral reinforcements 3. This horizontal plate 4, which is slightly offset laterally with respect to the central axis of the frame 1, supports a heat exchanger 6 comprising a cylindrical sheet-like bundle of water tubes 7 interconnected by a lower circular header 8 and an upper circular header 9, these tubes thus forming an interior cylindrical combustion chamber 10. The heat exchanger 6 is provided with a central opening 11 in its upper part and by contrast, it is closed by a bottom plate at its lower part.

Plumb with the central inlet opening 11 of the heat exchanger 6, the horizontal plate 4 includes a recess 12, intended first for the positioning within the heat exchanger 6 of a burner 13, which may be, for example, of the torch type, the flame of which is oriented toward the bottom, and second for the passage therethrough of the water inlet and outlet pipes 14 of the heat exchanger connected to the upper header 9.

The heat exchanger 6 is enveloped by a sealed, anti-noise shell 15 of substantially oval shape, which is supported immovably under the horizontal plate 4 by clips 16. This sealed shell 15, which may be of molded plastic or some similar semi-rigid or flexible product, has a groove 24 on its upper edge which is placed against the underside of the horizontal plate 4, and an O-ring 25 is disposed in this groove 24 to assure tight sealing. An opening 26 for the evacuation of the condensate is provided in the bottom of the sealed shell 15. The sealed shell 15 is laterally offset within the frame 1, and space is left beside it for the possible mounting of a water purifier, not shown.

An upper hood 17 which closes the frame serves to support the fresh-air inlet pipe 19, on the inside of which and coaxially therewith another pipe 18 of small diameter is disposed in a known manner, the latter pipe 18 being intended for evacuating the combustion gas products.

The upper part of the frame, defined on the bottom by the horizontal plate 4 and on the top by the hood 17, in turn defines a chamber which houses various elements assuring the circulation of the gas mixture. These elements include a distribution box or air box 20 having a flat, oblong shape mounted beneath the upper hood 17 such that it communicates directly with the air inlet pipe 19. The pipe 18 for evacuating the gases or combustion products discharging through the interior of the distribution box 20, is connected by means of a pipe fitting 21 with a vertical connecting tube 22, which is connected in turn with the sealed shell 15 via an opening 23 provided in the horizontal plate 4. At the level of the horizontal plate 4, adjacent the outer circumference of the sealed shell, there is provided an opening to which the connecting tube 22 for evacuating the combustion gases is connected. Connecting tube 22 is accordingly located approximately within the axis of the pipe 18 for evacuating the combustion products outside of the apparatus.

A mixing chamber for air and gas 27 is secured beneath the distribution box 20. At its upper part, the air-gas mixing chamber 27 communicates directly with the fresh-air inlet pipe 19 by means of the distribution box 20, and at one lateral face it is connected to the inlet opening 28 of a fan 29 by means of venture nozzle 30. A gas injector 31 disposed horizontally in the axis of the nozzle 30 permits gas to be injected and to be mixed with the air inside this nozzle.

The fan 29 is mounted beneath the upper hood 17 such that its outlet tube 32, connected directly with the burner 13, is located in the axis of the central inlet opening 11 of the heat exchanger 6.

The movement of air and gas in the interior of these various elements is thus assured by the fan 29. Fresh air is aspirated from the exterior via the pipe 19 and the distribution box 20 into the mixing chamber 27 to produce, with the gas fed into this mixing chamber, a combustible mixture which travels through the nozzle 30 into the fan 29 before being injected via the tube 32 into the burner 13, where it ignites. The products of combustion pass through the cylindrical sheet of water tubes 7, are collected in the sealed shell 15, and then are pumped to the exterior via the connecting tube 22 and the evacuation pipe 18.

The apparatus described herein by way of non-limiting example is thus of reduced bulk, permitting easy access for various mechanisms, and thus facilitating assembly, disassembly and maintenance operations. Furthermore, since these mechanisms are correctly aerated via the ambient atmosphere and are thermally insulated from the hot part of the apparatus by the sealed shell, they can be realized using conventional material, especially parts made of plastic.

Certain structural elements described herein can be used with a different configuration, without departing from the scope of the present invention; for instance, the shell 15 may be realized in the form of a parallelepipedic box likewise capping the outlet opening 23 for the products of combustion.

We claim:

1. A sealed forced-draft household gas boiler comprising a frame having mounted interiorly thereof a cylindrical heat exchanger, said heat exchanger including a bundle of water tubes surrounding a combustion chamber containing a burner disposed at one end, said burner being of the torch type and arranged such that its flame is directed into said combustion chamber, a mixing chamber, for mixing air and gas, a fresh-air inlet means for discharging air into the mixing chamber, an injector disposed for feeding gas into the mixing chamber, fan means for blowing the air and gas mixture into the burner, a sealed shell enveloping the heat exchanger, a means for evacuating combustion products collected in the sealed shell, a horizontal plate extending across the frame separating the interior of the frame into an upper portion and a lower portion, said fresh air inlet means for admitting air and said means for evacuating combustion products and said fan means being disposed above said plate, said sealed shell being suspended from said plate and extending into the lower portion, said heat exchanger, having a central inlet opening at the level of said plate, an outlet tube connected between the fan and the inlet opening, said outlet tube being in the axis of the inlet opening, and said shell having an outlet opening for the combustion products collected by the sealed shell traversing said plate and being located at least approximately in the axis of an evacuation pipe (18) for evacuating said combustion products exterior of the boiler.

2. A boiler as defined by claim 1, wherein the shell has a substantially oval shape, the outlet opening (23) for the products of combustion being disposed within the circumference of the shell at the level of the plate.

3. A boiler as defined by claim 1, wherein the shell has a substantially parallelepipedic shape, the outlet opening (23) for the products of combustion being disposed within the circumference of the shell at the level of the plate.

4. A boiler as defined in claim 2 wherein the shell is semi-rigid plastic.

5. A boiler as defined in claim 4 wherein the shell is flexible.

6. A boiler as defined by claim 1, further including clips for supporting the shell in an immovable manner underneath the horizontal plate.

7. A boiler as defined by claim 1, wherein the shell includes an upper edge having a groove, said edge being supported against the underside of the horizontal plate an O-ring within the groove for effecting a seal between the edge and the plate.

8. A boiler as defined by claim 1, further including a vertical connecting tube and a pipe fitting connecting the outlet opening (23) for the combustion products collected by the shell (15) to the evacuation pipe (18) for said products.

9. A boiler as defined by claim 1, wherein the bottom of the shell includes an opening (26) for evacuating the condensate.

10. A boiler as defined by claim 1, wherein the shell is laterally offset within the frame of the boiler so as to provide beside it a space for mounting water treating means.

11. A boiler as defined by claim 1, fresh air inlet means includes a distribution box (20) in the upper portion of the boiler arranged in communication with said mixing chamber.

12. A boiler as defined in claim 11, wherein the mixing chamber is affixed beneath the distribution box (20) and is in direct communication, via an upper part, with the fresh-air inlet means and, via a lateral face, connected with an inlet opening of the fan, said connection to the fan inlet opening being by means of a nozzle.

13. A boiler as defined by claim 1, wherein the central axis of the heat exchanger is slightly offset with respect to the axis of the evacuation pipe for evacuating the products of combustion and the fresh air inlet means for admitting the fresh air.

14. A boiler as defined by claim 1, wherein the horizontal plate includes a central recess for connecting the burner with the outlet tube of the fan and for allowing the passage therethrough of water inlet and outlet pipes for the heat exchanger.

15. A boiler as defined in claim 3 wherein the shell is semi-rigid plastic.

* * * * *